United States Patent [19]

Garg et al.

[11] Patent Number: 4,626,342

[45] Date of Patent: Dec. 2, 1986

[54] CATALYTIC COAL LIQUEFACTION PROCESS

[75] Inventors: Diwakar Garg, Macungie; Swaminathan Sunder, Allentown, both of Pa.

[73] Assignee: Air Products and Chemicals, Inc., Allentown, Pa.

[21] Appl. No.: 792,393

[22] Filed: Oct. 29, 1985

[51] Int. Cl.[4] ..... C10G 1/00; C10G 1/06

[52] U.S. Cl. ..... 208/419; 208/418; 208/435

[58] Field of Search ..... 208/10, 8 LE

[56] References Cited

U.S. PATENT DOCUMENTS

| | | | |
|---|---|---|---|
| 3,700,583 | 10/1972 | Salamony et al. | 208/8 |
| 4,049,536 | 9/1977 | Plumlee et al. | 208/10 |
| 4,049,537 | 9/1977 | Plumlee et al. | 208/10 |
| 4,051,012 | 9/1977 | Plumlee et al. | 208/8 |
| 4,057,484 | 11/1977 | Malek | 208/8 |
| 4,085,032 | 4/1978 | Aczel et al. | 208/10 |
| 4,085,033 | 4/1978 | Plumlee | 208/10 |
| 4,121,910 | 10/1978 | Stambaugh | 44/1 B |
| 4,435,522 | 3/1984 | Yoshii et al. | 208/10 X |
| 4,451,351 | 5/1984 | Porter et al. | 208/10 |
| 4,472,263 | 9/1984 | Garg et al. | 208/8 LE |
| 4,539,095 | 9/1985 | Sunder et al. | 208/8 LE |

OTHER PUBLICATIONS

Schweighardt et al., in Larsen, "Organic Chemistry of Coal", ACS Symposium Series, No. 71 (1978), pp. 240–257.

Lowry, ed., "Chemistry of Coal Utilization", Wiley, New York (1963), pp. 544–549.

*Primary Examiner*—Andrew H. Metz
*Assistant Examiner*—William G. Wright
*Attorney, Agent, or Firm*—Geoffrey Chase; E. Eugene Innis; James C. Simmons

[57] ABSTRACT

An improved process for catalytic solvent refining or hydroliquefaction of non-anthracitic coal at elevated temperatures under hydrogen pressure in a solvent comprises using as catalyst a mixture of a 1,2- or 1,4-quinone and an alkaline compound, selected from ammonium, alkali metal, and alkaline earth metal oxides, hydroxides or salts of weak acids.

23 Claims, 1 Drawing Figure

CATALYTIC COAL LIQUEFACTION PROCESS

The Government of the United States of America has rights in this invention pursuant to Contract No. DE-AC22-82-PC50003 awarded by the U.S. Department of Energy.

DESCRIPTION

1. Technical Field

The present invention is directed to a process for making synthetic fuels from non-anthracitic coals. The process relates to producing liquid hydrocarbons and normally solid solvent-refined coal from raw mined coal, which has not been substantially pretreated. The present process is directed to improved catalytic solvent refining or coal liquefaction processes, in which the catalyst comprises a mixture of an ortho- or para-benzoquinone, naphthoquinone, anthracenequinone or higher polycyclic quinone and an alkaline compound having an ammonium, alkali metal or alkaline earth metal cation.

2. Background Art

The art of coal treatment to upgrade coal and provide alternative fuels, particularly liquid fuels to replace petroleum-derived liquid fuels, was first studied intensively in Germany in the 1920's. Research in the technology of coal upgrading has continued up to the present time, and was particularly active during the worldwide oil shortages of the 1970's.

Techniques for recovering more-easily utilized fuels from raw coal are generally known as coal liquefaction. Coal liquefaction can employ a wide variety of non-anthracitic substrates, particularly bituminous, subbituminous and lignitic coals. Other organic materials, e.g. peat can also be used.

Coal liquefaction processes broadly include both thermal (non-catalytic) and catalytic procedures. In thermal processes, heat is used to liquefy the coal without addition of extraneous catalytic materials. In thermal coal liquefaction processes, however, minerals, especially iron-bearing species, naturally found in the coal substrate may function as catalysts for the process.

Both catalytic and non-catalytic coal liquefaction processes can be performed in a variety of reactors, including slurry phase reactors and fluidized bed reactors.

Coal liquefaction processes attempt to bring about cleavage of weak heteroatom to carbon and strong carbon to carbon linkages in the coal structure. In the context of coal liquefaction, heteroatoms include nitrogen, oxygen and sulfur, bonded in any fashion to carbon of coal. The intermediate free radicals, resulting from cleavage of carbon-heteroatom and carbon-carbon bonds, are hydrogenated during liquefaction to prevent polymerization of the thus-produced free radicals to high molecular weight compounds.

Although hydrogen performs the necessary function of hydrogenation in coal liquefaction, it has been found that introduction of hydrogen by a hydrogen donor solvent is preferable to use of gaseous hydrogen alone. Hydrogen donor solvents must dissolve the products from coal liquefaction and must be capable of reversible hydrogenation and dehydrogenation. The donor solvent therefore functions as a hydrogen carrier, upon which hydrogen is loaded and introduced into the reaction mixture. Hydrogenated donor solvent then transfers hydrogen to free radicals generated during coal liquefaction and the hydrogen-depleted solvent is separated from the products and is rehydrogenated before recycling to the coal liquefaction reaction.

Malek (U.S. Pat. No. 4,057,484) has proposed adding an alkali metal or alkaline earth metal hydroxide, alkali metal carbonate or ammonium hydroxide to slurryform products of coal hydrogenation in a hydrogenation-dissolution pretreatment zone and then treating the slurryform materials in a second hydrogenation zone to effect rehydrogenation of the slurryform materials.

The use of a quinone additive at some point in a coal liquefaction process has been recited by Salamony et al. (U.S. Pat. No. 3,700,583), Plumlee et al. (U.S. Pat. Nos. 4,051,012; 4,049,537; and 4,049,536), Plumlee (U.S. Pat. No. 4,085,033) and Aczel et al. (U.S. Pat. No. 4,085,032). Salamony et al. U.S. Pat. No. 3,700,553 teach in situ formation of quinones by oxidation of a liquid hydrocarbon product and combining the oxidized quinone-containing product with solvent and hydrogen in a rehydrogenation zone, in contact with a heterogeneous catalyst or Group VIB/VIII metal hydrogenation catalyst.

Plumlee et al. U.S. Pat. No. 4,051,012 teach preliminary liquefaction of a coal-solvent slurry, separation of products and hydrogenation of solvent for recycle in the presence of a quinone catalyst.

Plumlee et al. U.S. Pat. Nos. 4,049,536 and 4,049,537 teach addition of an ortho- or para-quinone to solvent in a mixing zone of a liquefaction process and subjecting the resulting mixture to liquefaction conditions. The processes said to obviate the need for a hydrogen donor solvent. Plumlee U.S. Pat. No. 4,085,033 and Aczel et al. U.S. Pat. No. 4,085,032 are of similar interest.

It is an object of this invention to provide a simple binary catalyst system for hydroliquefaction of unpretreated coal feeds, in which the hydroliquefaction to high yields of oil and high coal conversions can be obtained in essentially a single step process.

DISCLOSURE OF INVENTION

In one aspect, this invention relates to an improved process for catalytic solvent refining of coal at an elevated temperature and pressure in the presence of hydrogen and a solvent, wherein the catalyst comprises a combination of:

(a) a mono- or polycyclic, substituted or unsubstituted 1,2- or 1,4-quinone and (b) an ammonium, alkali metal, or alkaline earth metal oxide, hydroxide or salt of a weak acid.

The catalyst, used in the process of this invention, has two components. The first is an alkaline material, selected from ammonium, alkali metal and alkaline earth metal oxides, hydroxides or salts of weak acids. Weak acids are those which ionize to a limited extent in water. Typical weak acids are those having the following anions: carbonate, bicarbonate, sulfide, benzoate, acetate, propionate, and the like.

The alkaline catalyst component can be introduced into the slurry mixer as a solid or slurry or in the form of a solution in water or in an organic solvent.

Alkali metals include sodium, potassium and lithium, whereas alkaline earth metals include calcium, magnesium, barium and strontium.

Preferred alkaline catalyst components are those of the alkali metals, particularly sodium or potassium oxide, hydroxide, carbonate, bicarbonate, sulfide, benzoate, acetate or propionate. Most preferred alkaline catalyst components are sodium hydroxide, sodium carbonate or sodium sulfide.

The amount of alkaline catalyst component is at least 0.01% by weight of coal feed, preferably at least 0.1% by weight of coal feed. The catalyst level will not normally exceed 5% by weight of the coal feed. Most preferably, the catalyst will contain 0.25–1.5% by weight of sodium hydroxide, sodium carbonate or sodium sulfide.

The second catalyst component is a 1,2-(ortho-) or 1,4-(para-)quinone, which may be monocyclic or polycyclic and may be unsubstituted or substituted. Quinones which can be used include, but are not limited to, substituted and unsubstituted benzoquinones, naphthoquinones, anthraquinones, pyrenequinones, benzanthracenequinones, picenequinones, chrysenequinones, dibenzanthracenequinones and benzpyrenequinones. Substituted quinones include those having alkoxy, e.g., methoxy, ethoxy or propoxy; alkyl, e.g., methyl, ethyl, propyl, butyl, pentyl, hexyl; aryl, e.g., phenyl, tolyl or xylyl; carboxy, hydroxy, or amino groups at any position of the polycyclic nucleus, other than that of a quinone oxygen. The quinones can be fed to the mixer as a solid, a slurry or a solution or dispersion in a liquid medium. It will be understood that quinones can be derived from the process solvent, as taught by Salomony et al., U.S. Pat. No. 3,700,553, supra.

Preferred quinones are 1,4- or para-quinones, particularly 1,4-benzoquinones, 1,4-naphthoquinones and 9,10-anthraquinones (9,10-anthracenediones). Most preferred is 1,4-benzoquinone.

The amount of quinone catalyst is at least 0.01% by weight of coal feed, preferably 0.1% by weight, most preferably 0.25–1.5% by weight. The maximum amount of quinone catalyst to be added is of the order of 5% by weight of coal feed.

A most preferred catalyst composition comprises 0.25–1.5% by weight of p-benzoquinone and 0.25–1.5% by weight of sodium hydroxide, sodium carbonate or sodium sulfide, each with respect to coal feed.

Hydroliquefaction or solvent refining of coal, in accordance with the present invention, may be done by treatment of a coal feed with hydrogen, at elevated temperatures and presssures, in a solvent. In general, hydroliquefaction is done by slurrying particulate coal with solvent and heating the resulting slurry in the presence of hydrogen at elevated temperatures, generally above 350° C., to convert the coal to products of lower molecular weight. It is contemplated that the process of the present invention can utilize non-hydrogen donor solvents as well as hydrogen donor solvents.

The coal feed, used for hydroliquefaction or solvent refining, is selected from non-anthracitic coals, including bituminous, sub-bituminous and lignite coals. Peat and similar organic feedstocks may also be used in these processes. The coals used as feed may be wet or dry, that is, containing less than about 5% by weight of water. When wet coals are used as feed for the process, the slurry preparation temperature may be selected so as to dehydrate the coal feed during the slurry preparation step.

The solvent used in solvent refining processes is a hydrogen donor or non-hydrogen donor, boiling above about 230° C. Although the solvent is conveniently derived from the coal feed being liquefied, it is feasible to use solvents of the proper boiling range, obtained from petroleum, shale or tar sands. It will be understood that, in processes in which solvent is recycled, solvents of other origin will gradually be replaced by coal-derived solvent. In general, solvent used for hydroliquefaction are selected among those having a boiling range of 230°–455° C. It is preferred to use a hydrogen donor solvent.

It has been found that solvents, from which at least some oxygenated or nitrogenous impurities, or both, have been removed, provide coal conversions and oil yields, higher than those obtained using untreated/unmodified solvents.

Nitrogenous impurities in solvents, derived from coal, petroleum, shale or tar sands, include those present as strongly basic nitrogen, i.e., N; "acidic" nitrogen, NH; and those in the form of weakly basic (neutral) nitrogen, $NH_2$. Nitrogenous impurities of the foregoing types are defined in accordance with Schweighardt et al., "Heteroatom Species in Coal Liquefaction Products," in Larson, ed., "Organic Chemistry of Coal," ACS Symposium Series, no. 71(1978), pages 240–257.

Strongly or highly basic nitrogenous contaminants include pyridines, azaindans, dihydroquinolines, indoles, quinolines, phenylpyridines, azafluorenes, acridines, benzo[ghi]azafluorenes, azapyrenes, benzacridines, benzo[ghi]azafluoranthenes, benzazapyrenes, phenanthridines, dibenzacridines, azaanthanthrenes, dibenzazapyrenes and azacoronenes.

"Acidic" or weakly basic nitrogenous contaminants include carbazoles, phenylindoles, benzo[def]carbazoles, benzocarbazoles, phenylcarbazoles, dibenzocarbazoles, naphthylcarbazoles, naphthobenzo[def]carbazoles, anthracenocarbazoles, anthranylcarbazoles, anthracenobenzo[def]carbazoles and dinaphthocarbazoles.

Neutral nitrogenous contaminants include primary aromatic amines, e.g. aniline, toluidines, xylidines, alpha- and beta-naphthylamines, various aminophenanthrenes, anthracenes, benzanthracenes and the like.

Contaminants having strongly basic nitrogen functionality can be removed by treating the solvent with an acid, for example, anhydrous hydrogen chloride, to precipitate amino compounds as corresponding hydrochlorides and permit their facile separation from the solvent before use.

Although treatment with hydrogen chloride is among the simplest ways in which to remove basic-nitrogen compounds from solvents, it is contemplated that alternative methods of removing these compounds could include formation of complexes with hydrogen fluoride, adsorption of complexes formed by passage of the solvent over solid supports, including ion-exchange resins, acid clays, acidic zeolites, acidic aluminas, silicas, charcoals or carbon based surface-active agents. The formation of insoluble sulfates by treatment with weak solutions of sulfuric acid is also contemplated as a separation method. In some instances, the amount of nitrogenous contaminants could be decreased by selective distillation.

Removal or extraction of nitrogenous impurities can be done at any temperature, from below ambient to above 345° C., at which point substantial amounts of the solvents of interest are generally in the vapor phase. The separations can be done under pressures from ambient up to $1.4\times10^6$ kg/m$^2$.

Removal of acids, used to complex with amines in the solvents, may be done by washing with water, percolation over solid basic materials or treatment with ammonia. Although it is preferred that the entire solvent feed and recycle stream be treated to remove nitrogenous contaminants, it will be understood that, if the content or accumulation of nitrogenous impurities is below the limit, deemed acceptable for particular hydroliquefaction conditions, removal of nitrogenous materials need not be done.

The equipment, used to remove nitrogenous impurities, in a process steam is, preferably, of the continuous type. However, batch processing, for example, in a stirred reactor, will be acceptable for experimental purposes or whenever an adequate supply of low nitrogen solvent is available.

It was found that quinoline and phenanthridine were representative of nitrogenous impurities, having particularly deleterious effects on catalytic coal liquefaction. Therefore, it is preferred that this type of highly basic nitrogenous impurities be essentially completely removed.

It is preferred, in the process of this invention, that the level of total nitrogenous impurities in the modified hydroliquefaction solvent is 0.3% by weight or less, more preferably 0.1% by weight or less of highly basic nitrogen. Most preferably, the level of highly basic nitrogen is 0.01% or less.

Alternatively, it is preferred that at least 25% by weight of nitrogenous impurities originally present in the solvent be removed. More preferably, 50% by weight of nitrogenous impurities will be removed; most preferably, 75% by weight. More preferably, at least 50% by weight of highly basic nitrogenous impurities (as N) will be removed. Most preferably, at least 75% by weight of highly basic nitrogenous impurities will be removed.

Oxygenated impurities include phenols (OH functionality) and ethers (—O—). Phenolic inpurities are generally those identified by Karr et al., Brewer et al., Fowkes et al. or Jäger et al., as set forth in Lowry, ed., "Chemistry of Coal Utilization," John Wiley & Sons, Inc., New York (1963), pages 544–549.

It is preferred that phenolic contaminants be removed. Phenolic impurities, or other oxygenated species having reactive hydroxyl functions, can be removed in any of the following representative ways:

(a) complexation of phenols by percolating phenol-containing solvent through tubular columns packed with ion-exchange resins, basic clays, basic zeolites, basic or neutral aluminas, or active carbons or silicas (b) extraction with dilute solutions of alkali metal hydroxides, for example, sodium, potassium or calcium hydroxides (c) formation of derivatives with silanes, e.g., with hexamethyldisilizane or (d) selective distillation.

As was the case for removal of nitrogenous impurities, these processes can be done at temperatures from ambient to about 345° C. and pressures from ambient to about $1.4\times10^6$ kg/m$^2$. The same types of equipment can be used for these separations, as used for removal of nitrogenous impurities.

An alternative method of removing oxygenated or nitrogenous contaminants from process solvent is by distillation. The solvent fraction boiling below about 335° C. is inherently richer in phenolic materials than the fraction boiling above about 335° C., which is rich in nitrogenous impurities. Either of these fractions can be further treated to remove the impurity of interest and the treated solvent can be returned to the process. The phenol-containing fraction can be oxidized to provide quinone-containing feed, which is returned to the process as one of the catalyst components.

It has been found, in the practice of this invention, that concentrations of total oxygen in oxygenated contaminants are preferably equal to or less than 1.0% by weight. Most preferred modified solvents are those containing 0.25% by weight or less of oxygen as phenolic contaminants.

Alternatively, solvents are preferred from which at least 50% by weight of oxygenated contaminants, originally present, have been removed.

It is further preferred that modified solvents used for hydroliquefaction have low oxygen and low nitrogen analyses, preferably equal to or less than 1.0% by weight of total oxygen and equal to or less than 0.3% by weight of total nitrogen. More preferably, the solvents will contain 0.25% by weight or less of phenolic oxygen and 0.1% or less by weight of highly basic nitrogen. Most preferably, the modified solvents will have 0.01% by weight or less of highly basic nitrogen content, in addition to the indicated limit on oxygen.

Solvents meeting these criteria will normally contain less than 50% by weight of nitrogenous contaminants and 50% by weight of oxygenated contaminants, originally present in the solvent. More preferably, the solvents will contain less than 25% by weight of nitrogenous contaminants and less than 25% by weight of oxygenated contaminants, originally present in the solvent. Most preferably, the solvents will contain less than 25% by weight of highly basic nitrogenous contaminants and less than 25% by weight of oxygenated contaminants, originally present in the solvent.

The coal feed is normally transferred to the solvent refining reactor or reaction zone in the form of a slurry with the solvent. The concentration of coal in the slurry may vary from 10% to 50% by weight of the slurry, that is, the ratio of coal to solvent is normally within the ratios 1:1 to 1:10 by weight. It is preferred to use coal slurries having 1:3 to 1:1 ratios of coal to solvent.

The coal-solvent slurry is conveniently transferred from the slurry preparation reactor or zone to the liquefaction reactor under pressure, from about $1.4\times10^5$ to $3.5\times10^6$ kg/m$^2$. If the slurry was prepared under an inert atmosphere, hydrogen is introduced into the system during transfer to the hydroliquefaction reactor. If hydrogen was present during slurry preparation, additional hydrogen, to provide the desired pressure, is introduced during transfer to the hydroliquefaction reactor.

The feed slurry, plus hydrogen, can also be preheated in a preheater to the desired reaction temperature. It is preferred that the outlet temperature of the preheater is 375°–455° C., more preferably 375°–425° C., and that the temperature in the hydroliquefaction reactor is 400°–485° C. The residence time of the feed slurry in the hydroliquefaction reactor is 5–300 minutes, preferably 5–60 minutes. The hydrogen flow rate is normally 62.4–936 m$^3$/metric ton of coal. Hydrogen used in the preheater can also contain hydrogen sulfide.

It will be understood that a number of chemical transformations take place in the hydroliquefaction reactor. The preferred conversions include those of coal to distillate oil. Products from the hydroliquefaction reactor are passed through a gas-liquid separator to recover product gases and unused hydrogen, which is recycled. The condensed phase is further treated to recover net distillate products and process solvent, part of which may be withdrawn as a net distillate oil product. More particularly, product is withdrawn as $C_1$–$C_5$ hydrocarbon gases and oil (bp 150°–455° C.) fractions.

Recovered solvent can be, and preferably is, recycled to the process. The distillation bottoms can be further separated to recover unconverted coal, minerals and ash, using methods well known in the art, including filtration, sub-critical and super-critical solvent deashing, and anti-solvent deashing. Deashed and demineralized distillation bottoms are identified as solvent-refined coal (SRC), a solid at room temperature, which is withdrawn as net product. The SRC can be used as a feedstock for making anode coke, used as boiler fuel, or reprocessed to make additional distillate oil. The residue containing unconverted coal, minerals and ash can be gasified to make hydrogen.

Conventional coal liquefaction is believed to begin with the generation of coal free radicals by thermal scission. The process solvent used for the liquefaction is thought to act as a hydrogen shuttler, which abstracts hydrogen from the gas phase and transfers hydrogen to the thus-produced coal free radicals. The aromatic/hydroaromatic compounds present in the process solvent are usually credited with this activity. Studies with model compounds have shown that large condensed ring compounds are more active in this regard than smaller aromatic compounds.

The effectiveness of a solvent is determined by the ratio of the rate at which hydrogen is shuttled to the free radical to the rate at which the free radicals undergo competing condensation reactions. It is known that the competing condensation reactions produce refractory materials and that excessive amounts of hydrogen are required for liquefaction, when radical condensation reactions predominate.

It is proposed that the basic catalysts employed here enhance the rate of the quinone-dihydroxyaromatic interconversion. This permits more rapid hydrogen shuttling to the coal free radicals than heretofore and results in improved yields of liquid products.

Although the foregoing presents a proposed theoretical explanation of the mechanism by which the present invention operates, it will be understood that the inventors do not wish to be bound by such explanation and rely on the appended claims to define the invention.

In FIG. 1 is shown schematically a preferred process in accordance with the invention. Particulate coal feed is introduced into the slurry mix zone (mixer). Solvent from storage or the solvent recycle system is introduced into the mixer through another line. The quinone and base components of the catalyst system are introduced into the mixer and the coal-solvent slurry is prepared. During transfer of the solvent-coal slurry into the hydroliquefaction zone (liquefaction reactor), hydrogen is introduced into the transfer line to pressurize the liquefaction feed to the desired pressure.

At the end of the desired residence time in the liquefaction reactor, the liquefacton products are transferred from the liquefaction reactor to a gas/liquid separator means, in which product gases are separated from the system. The condensate from the gas/liquid separator is passed through a transfer line to a distillation unit. Light oil distillate fraction (boiling up to about 218° C.) leaves the still for transfer to storage. Recycle distillate solvent is transferred from the vacuum distillation zone to solvent storage or recycled to the mixer.

Bottoms from the vacuum distillation unit are transferred a solids separation zone (deashing unit). The bottoms fraction contains soluble solvent-refined coal (SRC) and a residue (IOM), comprising insoluble organic materials, unconverted coal macerals and mineral matter. This material can be used for generating hydrogen in a gasifier.

BEST MODE FOR CARRYING OUT THE INVENTION

Figure 1:
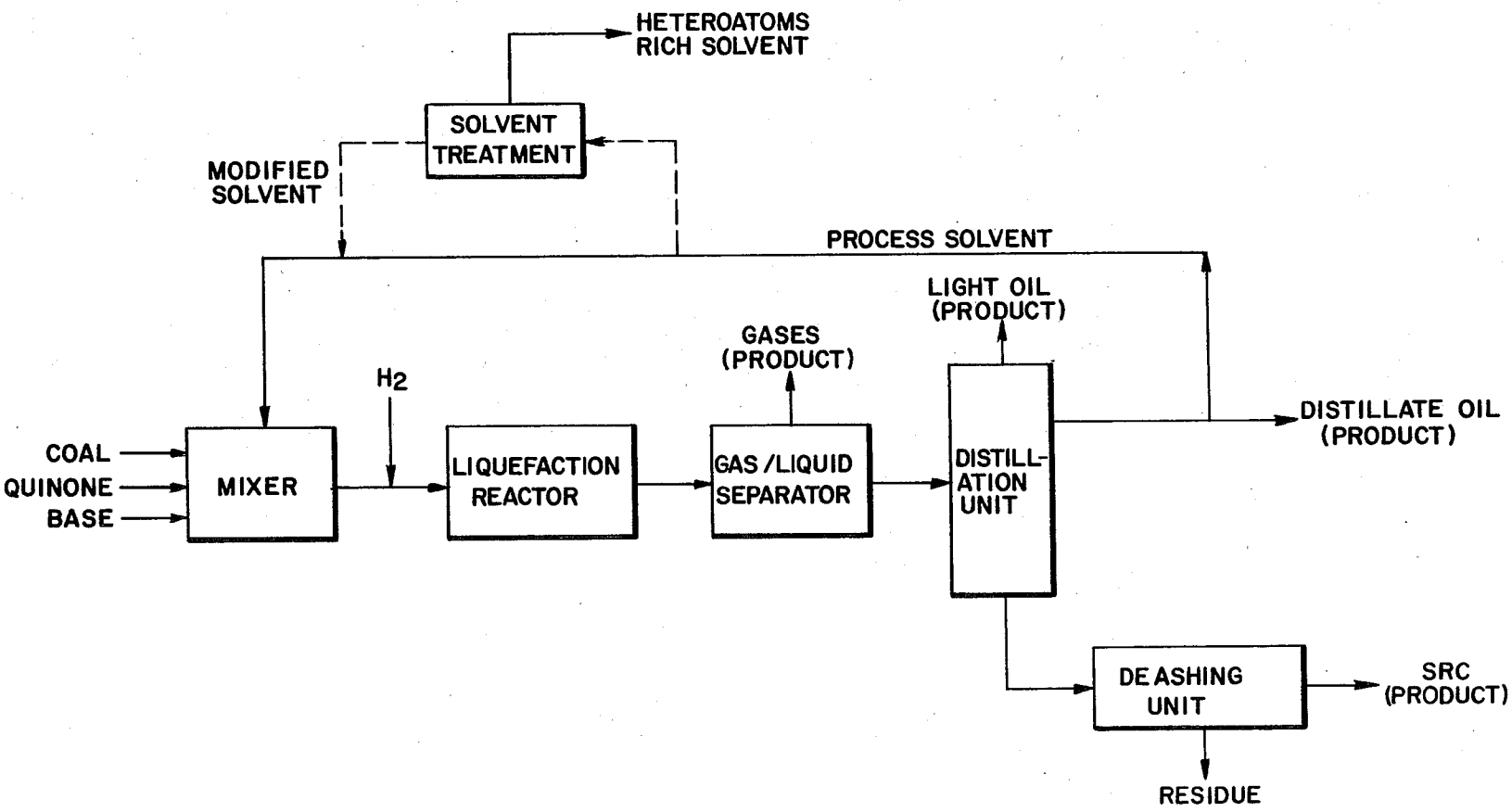
In FIG. 1 is shown a schematic representation of a preferred embodiment of the invention.

In a most preferred aspect, the process of the invention is that wherein the catalyst comprises 0.25–1.5% by weight of 1,4-benzoquinone and 0.25–1.5% by weight of sodium hydroxide, sodium carbonate or sodium sulfide, based on coal feed and the solvent refining is done at a temperature of at least 400° C., a hydrogen pressure of at least $3.5\times10^5$ kg/m$^2$ and a residence time of 5–300 minutes.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

In the following examples, temperatures are set forth uncorrected in degrees Celsius. Unless otherwise indicated, all parts and percentages are by weight.

EXAMPLE 1

Hydroliquefaction of Coal with Original Coal-derived Process Solvent

A slurry of 3 g of Illinois no. 6 coal, of the composition given in Table 1, in 3 g of original process solvent, derived from the hydroliquefaction process and having the elemental composition and boiling range given in Table 2, was prepared.

The coal-solvent slurry was treated in a 50-ml tubing-bomb reactor under a hydrogen pressure before heating of $8.43\times10^5$ kg/m$^2$. The hydroliquefaction was carried out as in U.S. Pat. No. 4,472,263, herein incorporated by reference. The reaction temperature was 440° C. and residence time was 60 min.

At the end of the 60-minute reaction period, the reactor was cooled and the product separated into gas and liquid fractions. The liquid fraction was further divided into an oil fraction (soluble in n-pentane), solvent-refined coal (SRC, insoluble in n-pentane, soluble in methanol:methylene chloride 10:90 mixture) and insoluble organic materials (IOM, insoluble in n-pentane or methylene chloride:methanol mixture). The product distribution from two duplicate runs is given in Table 3. The yield of oil was about 29%, based on moisture-ash-free (MAF) coal, and the conversion of coal was 75–78%.

TABLE 1

| Analysis of Illinois #6 Coal | Weight % (as received basis) |
|---|---|
| Proximate Analysis | |
| Moisture | 2.54 |
| Ash | 10.46 |
| Volatile | 37.56 |
| Fixed Carbon | 49.44 |
| Ultimate Analysis | |
| Carbon | 68.43 |
| Hydrogen | 4.96 |
| Nitrogen | 1.38 |
| Sulfur | 3.23 |
| Oxygen (by difference) | 8.93 |

TABLE 1-continued

| Analysis of Illinois #6 Coal | Weight % (as received basis) |
|---|---|
| Distribution of Sulfur | |
| Total Sulfur | 3.23 |
| Pyrite Sulfur | 1.09 |
| Organic Sulfur | 2.14 |

EXAMPLE 2

Hydroliquefaction of Coal with p-Benzoquinone Catalyst

To a slurry of 3 g of coal (Table 1) in original process solvent (Table 2) was added 0.03 g of p-benzoquinone. The slurry was subjected to hydroliquefaction, under conditions otherwise as in Example 1. Results, given in Table 3, were a slightly higher oil yield and about the same conversion as for hydroliquefaction without an additive.

EXAMPLE 3

Hydroliquefaction of Coal with p-Benzoquinone Catalyst

To a slurry of 3 g of coal (Table 1) and 3 gram of original process solvent (Table 2) was added 0.06 g of p-benzoquinone. The resulting slurry was subjected to hydroliquefaction and the products were isolated as in Example 1. As shown in Table 3, increasing the amount of p-benzoquinone above that of Example 2 lowered both oil yield and conversion of coal.

EXAMPLE 4

Hydroliquefaction of Coal with Sodium Carbonate Catalyst

To a slurry of 3 g of Illinois no. 6 coal (Table 1) and 3 g of original process solvent (Table 2), was added 0.03 g of sodium carbonate. The slurry was subjected to hydroliquefaction under the conditions of Example 1. As shown by the results in Table 3, use of an alkaline material increased both oil yield and conversion of coal.

EXAMPLE 5

Hydroliquefaction of Coal with Sodium Hydroxide Catalyst

To a slurry of 3 g of Illinois no. 6 coal in 3 g of original process solvent was added 0.03 g of sodium hydroxide. The slurry was subjected to hydroliquefaction as in Example 1.

Results, given in Table 3, show that use of sodium hydroxide catalyst increased both oil yield and coal conversion significantly.

TABLE 2

| | Weight % | |
|---|---|---|
| | Original | Modified |
| Analysis of Original and Modified Process Solvents | | |
| Elemental | | |
| Carbon | 88.02 | 89.52 |
| Hydrogen | 8.57 | 9.06 |
| Oxygen | 2.25 | 0.81 |
| Nitrogen | 0.67 | ≦0.01 |
| Sulfur | 0.62 | 0.66 |
| Distribution of Nitrogen | | |
| N as N, e.g., pyridine | 0.28 | ≦0.01 |
| N as NH, e.g., carbazole | 0.15 | ≦0.01 |
| N as $NH_2$, e.g., aniline | 0.24 | ≦0.01 |
| Distribution of Oxygen | | |
| O as O, e.g., ether | 1.10 | 0.60 |
| O as OH, e.g., phenol | 1.15 | 0.21 |
| Boiling Point Distribution of Original and Modified Process Solvents | | |
| Temp., °C. | | |
| IBP-177 | 0.00 | 0.00 |
| 177–232 | 2.80 | 1.03 |
| 232–288 | 10.77 | 9.51 |
| 288–343 | 28.55 | 27.52 |
| 343–399 | 25.23 | 29.36 |
| 399–454 | 29.89 | 29.54 |
| 454-FBP | 2.76 | 3.04 |

TABLE 3

Conversion and Product Distribution Obtained During Coal Liquefaction

| | Example 1 | | Example 2 | Example 3 | Example 4 | Example 5 |
|---|---|---|---|---|---|---|
| Process Solvent | Original | | Original | Original | Original | Original |
| Additive | None | | 1% PBQ[e] | 2% PBQ | 1% $Na_2CO_3$ | 1% NaOH |
| Product Distribution, wt. % MAF Coal | I | II | | | | |
| Gas[a] | 10.5 | 12.9 | 9.6 | 13.7 | 8.5 | 7.8 |
| Oil[b] | 29.1 | 29.3 | 31.4 | 25.7 | 38.8 | 40.9 |
| SRC[c] | 35.6 | 36.0 | 37.2 | 28.9 | 32.4 | 35.9 |
| IOM[d] | 24.8 | 21.8 | 21.8 | 31.7 | 20.3 | 15.4 |
| Conversion (%) | 75.2 | 78.2 | 78.2 | 68.3 | 79.7 | 84.6 |

| | Example 6 | Example 7 | Example 8 | Example 9 | Example 10 | Example 11 | |
|---|---|---|---|---|---|---|---|
| Process Solvent | Original | Original | Modified | Modified | Modified | Modified | |
| Additive | 1% PBQ[e] + 1% $Na_2CO_3$ | 1% PBQ + 1% NaOH | None | 1% PBQ | 1% $Na_2S$ | 1% PBQ + 1% $Na_2S$ | |
| Product Distribution, wt. % MAF Coal | | | | | | I | II |
| Gas[a] | 8.0 | 7.0 | 11.3 | 7.7 | 7.9 | 13.1 | 9.7 |
| Oil[b] | 43.5 | 46.5 | 33.9 | 33.6 | 41.3 | 45.6 | 45.1 |
| SRC[c] | 35.1 | 33.4 | 32.2 | 31.3 | 36.9 | 30.6 | 32.3 |
| IOM[d] | 13.4 | 13.1 | 22.6 | 27.4 | 13.9 | 10.7 | 12.9 |
| Conversion (%) | 86.6 | 86.9 | 77.4 | 72.6 | 86.1 | 89.3 | 87.1 |

[a] $C_1$–$C_5$ hydrocarbons, $NH_3$, CO, $CO_2$ and $H_2S$
[b] Pentane solubles
[c] Pentane insolubles, methylene chloride/methanol solubles
[d] Pentane and methylene chloride/methanol insolubles
[e] p-Benzoquinone

EXAMPLE 6

Hydroliquefaction of Coal with p-Benzoquinone/Sodium Carbonate Catalyst

To a slurry of 3 g of Illinois no. 6 coal and 3 g of original process solvent was added 0.03 g of p-benzoquinone and 0.03 g of sodium carbonate. The resulting mixture was subjected to hydroliquefaction under conditions of Example 1.

As shown in Table 3, a combination of sodium carbonate and p-benzoquinone resulted in a higher oil yield and higher conversion than an uncatalyzed reaction, or a reaction using p-benzoquinone or sodium carbonate alone.

EXAMPLE 7

Hydroliquefaction of Coal with p-Benzoquinone/Sodium Hydroxide Catalyst

To a slurry of 3 g of Illinois no. 6 coal in 3 g of original process solvent was added 0.03 g of p-benzoquinone and 0.03 g of sodium hydroxide. The mixture was treated under hydroliquefaction conditions of Example 1.

As shown in Table 3, higher oil yield and higher conversion were obtained than for a uncatalyzed hydroliquefaction or for hydroliquefaction, catalyzed by p-benzoquinone or sodium hydroxide alone.

EXAMPLE 8

(a) Removal of Nitrogenous Contaminants from Process Solvent

Process solvent, having the original properties, given in Table 2, was mixed with n-pentane in a beaker (5:1 n-pentane:solvent by volume). Anhydrous hydrogen chloride was bubbled through the resulting solution for 5 min and excess hydrogen chloride was sparged from the solution with a stream of nitrogen. The supernatant solution was decanted to remove precipitated nitrogen bases and neutralized with a stream of ammonia gas. Excess ammonia gas was removed from the solution by a stream of nitrogen. The ammonium chloride precipitate, which formed by reaction with hydrogen chloride, was removed by filtration.

(b) Removal of Phenolic Impurities

The nitrogen-base free solution obtained in part (a) was mixed with silica gel, using equal weights of silica gel and treated solvent. The solvent was left in contact with the silica gel under ambient conditions for 30 min, after which the liquid was removed by decantation and the silica gel was washed with additional n-pentane. The combined solution and pentane washings were evaporated using a rotary evaporator to recover process solvent, essentially free of nitrogenous and phenolic contaminants. Properties of the treated (modified) process solvent are given in Table 2.

(c) Hydroliquefaction of Coal in Modified Process Solvent

A feed slurry of Illinois no. 6 coal (3 g, analysis in Table 1) and 3 grams of the modified process solvent of Example 8(b) was treated at 440° C., at a cold hydrogen pressure of $8.43\times10^5$ kg/m$^2$ and a residence time of 60 minutes, in the tubing-bomb reactor employed in Example 1. The product mixture was separated as above.

As shown by the results in Table 3, hydroliquefaction with nitrogen-free, phenol-free solvent afforded a higher yield of oil but about the same conversion of coal as either run of Example 1.

EXAMPLE 9

Hydroliquefaction of Coal in Modified Process Solvent with p-Benzoquinone Catalyst To a slurry of Illinois no. 6 coal (Table 1) in 3 g of modified process solvent of Example 8(b) was added 0.03 g of p-benzoquinone. The resulting mixture was subjected to hydroliquefaction under conditions of Example 1.

As shown in Table 3, oil yield for the catalyzed reaction was about the same as for an uncatalyzed reaction and coal conversion was lower. This example shows that use of p-benzoquinone as the sole catalyst component is detrimental to liquefaction in the presence of modified process solvent.

EXAMPLE 10

Hydroliquefaction of Coal in Modified Process Solvent with Sodium Sulfide Catalyst To a mixture of 3 g of Illinois no. 6 coal and 3 g of modified process solvent of Example 8(b) was added 0.03 g of sodium sulfide. The resulting mixture was subjected to hydroliquefaction under conditions of Example 1.

As shown in Table 3, sodium sulfide catalyst raised both oil yield and coal conversion.

EXAMPLE 11

Hydroliquefaction of Coal in Modified Process Solvent with Sodium Sulfide/p-Benzoquinone Catalyst To 3 g of Illinois no. 6 coal and 3 g of modified process solvent of Example 8(b) was added 0.03 g of p-benzoquinone and 0.03 g of sodium sulfide. The resulting mixture was subjected to hydroliquefaction under conditions of Example 1.

As shown in Table 3, the combined catalyst system resulted in significantly higher oil yield and coal conversion.

EXAMPLE 12

Effect of Solvents and Added Impurities on Molybdenum-catalyzed Hydroliquefaction

(a) Molybdenum-catalyzed Hydroliquefaction Using Original Process Solvent

Illinois No. 6 coal (Table 1, 3 g) was subjected to hydroliquefaction in 6 g of process-derived solvent (Table 2) in a 46.7 ml tubing-bomb reactor at 425° C. The reaction mixture contained 500 ppm of molybdenum catalyst, in the form of molybdenum octoate. The initial cold hydrogen pressure was $8.78\times10^5$ kg/m$^2$. The stirring rate was 860 rpm and the residence time was 60 min. The reaction was quenched and the products were isolated as in the foregoing examples. Results are shown in Table 4.

(b) Molybdeum-catalyzed Hydroliquefaction in Modified Process Solvent

Hydroliquefaction was carried out as in Example 12(a), using 3 g of Illinois no. 6 coal, 6 g of solvent, treated as in Example 8(b), and 500 ppm of molybdenum catalyst, in the form of the octoate. It is apparent from the results in Table 4 that treatment of the solvent improved the yield of oil.

(c–f) Addition of Nitrogen Heterocycles to Modified Process Solvent

Experiments were run as in Example 12(a) using 3 g of Illinois no. 6 coal in 6 g of treated solvent, containing 500 ppm of molybdenum (as the octoate) and the indicated amounts by weight of impurities with respect to solvent, to provide media containing the indicated amount of nitrogen:

TABLE 4

| Experiment | Effect of Additives on Conversion and Product Distribution | | | | | | | |
|---|---|---|---|---|---|---|---|---|
| | a | b | c | d | e | f | g | h |
| Process Solvent | Original | Modified | Modified | Modified | Modified | Modified | Modified | Modified |
| Additive (%) | — | — | | | | | | |
| Quinoline | | | 5.9 | | | | | |
| Phenanthridine | | | | 7.7 | 30.5 | | | |
| Acridine | | | | | | 7.7 | | |
| beta-Naphthol | | | | | | | 13. | |
| Polar compound-rich stream | | | | | | | | 18 |
| Products (%) | | | | | | | | |
| Gas[a] | 11.8 | 9.7 | 11.9 | 9.6 | 8.9 | 9.9 | 9.5 | 10.5 |
| Oil[b] | 28.9 | 34.5 | 30.1 | 26.4 | 19.6 | 28.0 | 34.6 | 25.4 |
| SRC[c] | 51.9 | 49.2 | 51.6 | 56.5 | 65.8 | 53.8 | 48.4 | 57.9 |
| IOM[d] | 7.4 | 6.6 | 6.4 | 7.5 | 5.7 | 8.3 | 7.6 | 6.2 |
| Conversion % | 92.6 | 93.4 | 93.6 | 92.5 | 94.3 | 91.7 | 92.4 | 93.8 |

[a] $C_1$–$C_5$ hydrocarbons, hydrogen sulfide, ammonia, CO and carbon dioxide
[b] soluble in n-pentane
[c] insoluble in n-pentane and soluble in methylene chloride: methanol mixture
[d] insoluble in n-pentane and methylene chloride: methanol mixture

| | % added | % N | additive |
|---|---|---|---|
| b | — | 0.08 | — |
| c | 5.9 | 0.67 | quinoline |
| d | 7.7 | 0.67 | phenanthridine |
| e | 30.5 | 2.42 | phenanthridine |
| f | 7.7 | 0.67 | acridine |

As shown in Table 4, addition of quinoline to treated solvent gave a lower oil yield in the product than obtained with treated solvent, containing about the same amount of total nitrogen as untreated solvent. A run in solvent, containing 7.7% by weight of phenanthridine, gave even lower yields of oil fraction. Increasing the amount of phenanthridine (e) reduced the oil yield even more. Addition of acridine (7.7% by weight) gave lower oil yields than for modified solvent, but about the same oil yield as for untreated solvent, containing about the same amount of nitrogen. Therefore, nitrogenous compounds similar to phenanthridine (highly basic nitrogen) appear to have the most deleterious effects on molybdenum-catalyzed coal hydroliquefaction.

(g) Effect of Adding Oxygenated Compound to Modified Process Solvent

An experiment was run, otherwise as in Example 12(b), in which 13% by weight of beta-naphthol was added to the treated process solvent, to produce 2.25% total oxygen in the solvent. As shown in Table 4, addition of relatively low molecular weight phenolic impurities did not lower oil yields.

(h) Effect of Reconstituting Modified Process Solvent with Removed Impurities

Impurities removed from process solvent in Example 8 were added to the modified solvent to give a resulting mixture, having the same N and O analyses as the untreated feed solvent. When this was used for hydroliquefaction under conditions, otherwise as in Example 12(a), the resulting product mixture contained less oil than when untreated solvent or modified solvent was used. Therefore, removal of nitrogenous and oxygenated impurities from process solvent does enhance the amount of oil products obtained by molybdenum-catalyzed hydroliquefaction.

We claim:

1. In a process for catalytic solvent refining of coal at an elevated temperature and pressure in the presence of hydrogen and a hydrocarbon solvent to produce liquid hydrocarbons and normally solid solvent-refined coal, the improvement comprising using as catalyst a mixture of:

(a) from 0.01 to about 5% by weight of a mono- or polycyclic, substituted or unsubstituted 1,4- or 1,2-quinone with respect to coal feed and (b) from 0.01 to about 5% by weight of an ammonium, alkali metal, or alkaline earth metal compound selected from an oxide, hydroxide or salt of a weak acid, with respect to coal feed.

2. The process of claim 1, wherein the solvent is a hydrogen donor solvent.

3. The process of claim 1, wherein the catalyst contains an alkali metal oxide or hydroxide.

4. The process of claim 1, wherein the catalyst contains an alkali metal salt of a weak acid selected from a sulfide, carbonate, bicarbonate, benzoate, acetate or propionate.

5. The process of claim 1, wherein the catalyst contains a substituted or unsubstituted 1,4-benzoquinone.

6. The process of claim 1, wherein the catalyst contains a substituted or unsubstituted 1,4-naphthoquinone.

7. The process of claim 1, wherein the catalyst contains a substituted or unsubstituted 9,10-anthraquinone.

8. The process of claim 1, wherein the catalyst comprises at least 0.01% by weight of the ammonium, alkali metal or alkaline earth metal compound and at least 0.01% by weight of the 1,4- or 1,2-quinone, referred to coal feed.

9. The process of claim 1, wherein the catalyst comprises at least 0.1% by weight of the ammonium, alkali metal or alkaline earth metal compound and at least 0.1% by weight of the 1,2- or 1,4-quinone, referred to coal feed.

10. The process of claim 1, wherein the catalyst comprises 0.25–1.5% by weight of the alkali metal oxide, hydroxide or salt of a weak acid and 0.25–1.5% by weight of the 1,4-benzoquinone, referred to coal feed.

11. The process of claim 1, wherein the catalyst comprises 0.25–1.5% by weight of sodium sulfide and 0.25–1.5% by weight of the 1,4-benzoquinone, referred to coal feed.

12. The process of claim 1, wherein the catalyst comprises 0.25–1.5% by weight of an alkali metal carbonate or bicarbonate and 0.25–1.5% by weight of the 1,4-benzoquinone, referred to coal feed.

13. The process of claim 1, wherein the catalyst comprises 0.25–1.5% by weight of the alkali metal hydroxide and 0.25–1.5% by weight of the 1,4-benzoquinone, referred to coal feed.

14. The process of claim 1, wherein the solvent is derived from the solvent refining process.

15. The process of claim 1, wherein the solvent is derived from the solvent refining process and is a hydrogen donor solvent.

16. The process of claim 1, wherein the solvent is derived from the solvent refining process and at least one nitrogenous or oxygenated contaminants have been removed therefrom.

17. The process of claim 1, wherein the solvent is a hydrogen donor solvent, derived from the solvent refining process, and at least some nitrogenous or oxygenated contaminants have been removed therefrom.

18. The process of claim 1, wherein solvent is recycled to the process.

19. The process of claim 18, wherein the solvent is a hydrogen donor solvent and at least some nitrogenous or oxygenated contaminants have been removed therefrom.

20. The process of claim 1, wherein solvent refining is done at a temperature of at least 400° C., a hydrogen pressure of at least $3.5\times10^5$ kg/m$^2$ and a residence time of 5–300 minutes.

21. The process of claim 1, wherein the catalyst comprises 0.25–1.5% by weight of sodium sulfide and 0.25–1.5% by weight of 1,4-benzoquinone, referred to coal feed; and wherein solvent refining is done at a temperature of at least 400° C., a hydrogen pressure of at least $3.5\times10^5$ kg/m$^2$ and a residence time of 5–300 minutes.

22. The process of claim 1, wherein the catalyst comprises 0.25–1.5% by weight of an alkali metal carbonate or bicarbonate and 0.25–1.5% by weight of 1,4-benzoquinone, referred to coal feed; and wherein solvent refining is done at a temperature of at least 400° C., a hydrogen pressure of at least $3.5\times10^5$ kg/m$^2$ and a residence time of 5–300 minutes.

23. The process of claim 1, wherein the catalyst comprises 0.25–1.5% by weight of sodium hydroxide and 0.25–1.5% by weight of 1,4-benzoquinone, referred to coal feed; and wherein solvent refining is done at a temperature of at least 400° C., a hydrogen pressure of at least $3.5\times10^5$ kg/m$^2$ and a residence time of 5–300 minutes.

* * * * *

UNITED STATES PATENT AND TRADEMARK OFFICE

CERTIFICATE OF CORRECTION

PATENT NO. : 4,626,342

DATED : December 2, 1986

INVENTOR(S) : Garg Diwakar and Sunder Swaminathan

It is certified that error appears in the above-identified patent and that said Letters Patent is hereby corrected as shown below:

Column 15, Line 24
Delete "one" and substitute therefor --some--

Signed and Sealed this

Eleventh Day of August, 1987

*Attest:*

DONALD J. QUIGG

*Attesting Officer*

*Commissioner of Patents and Trademarks*